US011492690B2

(12) United States Patent
Wilson

(10) Patent No.: US 11,492,690 B2
(45) Date of Patent: Nov. 8, 2022

(54) FERRITIC STAINLESS STEEL ALLOYS AND TURBOCHARGER KINEMATIC COMPONENTS FORMED FROM STAINLESS STEEL ALLOYS

(71) Applicant: Garrett Transportation I Inc, Torrance, CA (US)

(72) Inventor: Marc Wilson, Deyvillers (FR)

(73) Assignee: GARRETT TRANSPORTATION I INC, Torrance, CA (US)

( * ) Notice: Subject to any disclaimer, the term of this patent is extended or adjusted under 35 U.S.C. 154(b) by 55 days.

(21) Appl. No.: 16/918,007

(22) Filed: Jul. 1, 2020

(65) Prior Publication Data

US 2022/0002850 A1 Jan. 6, 2022

(51) Int. Cl.

| | |
|---|---|
| ***C22C 38/48*** | (2006.01) |
| ***C22C 38/00*** | (2006.01) |
| ***C22C 38/02*** | (2006.01) |
| ***C22C 38/44*** | (2006.01) |
| ***F04D 29/02*** | (2006.01) |

(52) U.S. Cl.

CPC ..... *C22C 38/48* (2013.01); *C22C 38/001* (2013.01); *C22C 38/002* (2013.01); *C22C 38/02* (2013.01); *C22C 38/44* (2013.01); *F04D 29/023* (2013.01)

(58) Field of Classification Search

CPC ..... C22C 38/48; C22C 38/001; C22C 38/002; C22C 38/02; C22C 38/44; F04D 29/023

USPC ..... 428/544

See application file for complete search history.

(56) References Cited

U.S. PATENT DOCUMENTS

| | | | | |
|---|---|---|---|---|
| 2,580,171 | A | 12/1951 | Hagglund et al. | |
| 2,709,132 | A | 5/1955 | Giles | |
| 3,086,858 | A | 4/1963 | Edminster et al. | |
| 3,617,258 | A | 11/1971 | Terada | |
| 5,582,657 | A * | 12/1996 | Watanabe | F01N 13/16 420/69 |
| 5,795,540 | A * | 8/1998 | Dwars | C22C 38/24 420/101 |
| 6,406,563 | B2 | 6/2002 | Kawano et al. | |
| 6,511,554 | B1 | 1/2003 | Kawano et al. | |
| RE40,950 | E | 11/2009 | Ota et al. | |
| 7,806,993 | B2 | 10/2010 | Miyazaki et al. | |
| 8,153,055 | B2 | 4/2012 | Nakamura et al. | |

(Continued)

FOREIGN PATENT DOCUMENTS

| | | | |
|---|---|---|---|
| CN | 106191702 | A | 12/2016 |
| DE | 102011081482 | A1 | 2/2013 |

(Continued)

*Primary Examiner* — Humera N. Sheikh
*Assistant Examiner* — Katherine A Christy
(74) *Attorney, Agent, or Firm* — Lorenz & Kopf LLP

(57) ABSTRACT

A terrific stainless steel alloy and turbocharger kinematic components are provided. A ferritic stainless steel alloy includes or consists of, by weight, about 20% to about 35% chromium, less than about 2% nickel (i.e., from 0% to about 2%), about 1% to about 4% carbon, about 1.5% to about 1.9% silicon, less than about 0.4% nitrogen (i.e., from 0% to about 0.4%), about 0.5% to about 15% molybdenum, less than about 1% niobium (i.e., from 0% to about 1%) and a balance of iron, and other inevitable/unavoidable impurities that are present in trace amounts. The turbocharger kinematic components are made at least in part using this stainless steel alloy.

18 Claims, 1 Drawing Sheet

(56) References Cited

U.S. PATENT DOCUMENTS

| | | | | |
|---|---|---|---|---|
| 2002/0139448 | A1 | 10/2002 | Hayashi et al. | |
| 2003/0165394 | A1 | 9/2003 | Kloss-Ulitzka et al. | |
| 2004/0166015 | A1 | 8/2004 | Kimura | |
| 2004/0226634 | A1 | 11/2004 | Hirasawa et al. | |
| 2005/0211348 | A1 | 9/2005 | Miyazaki et al. | |
| 2008/0107947 | A1 | 5/2008 | Jackson et al. | |
| 2009/0053092 | A1 | 2/2009 | Sandstrom et al. | |
| 2009/0269235 | A1 | 10/2009 | Fukae et al. | |
| 2010/0098994 | A1 | 4/2010 | Schuisky et al. | |
| 2010/0150770 | A1 | 6/2010 | Hiraide et al. | |
| 2010/0189588 | A1 | 7/2010 | Kawatsu et al. | |
| 2011/0008200 | A1 | 1/2011 | Kato et al. | |
| 2011/0033731 | A1 | 2/2011 | Kawano et al. | |
| 2011/0064601 | A1 | 3/2011 | Liljas et al. | |
| 2012/0273092 | A1 | 11/2012 | Ratte et al. | |
| 2012/0321501 | A1 | 12/2012 | Chae et al. | |
| 2013/0022488 | A1 | 1/2013 | Genma et al. | |
| 2013/0206271 | A1* | 8/2013 | Wieser | F16L 9/02 138/143 |
| 2019/0153557 | A1 | 5/2019 | Herbst et al. | |

FOREIGN PATENT DOCUMENTS

| | | | |
|---|---|---|---|
| EP | 0530604 | A2 | 3/1993 |
| EP | 0655511 | A1 | 5/1995 |
| EP | 1826288 | A1 | 2/2007 |
| EP | 2623623 | A1 | 8/2013 |
| JP | 07197209 | A | 7/2000 |
| JP | 2000204946 | A1 | 7/2000 |
| JP | 2010215951 | A | 9/2010 |
| WO | 2012170210 | A2 | 12/2012 |

* cited by examiner

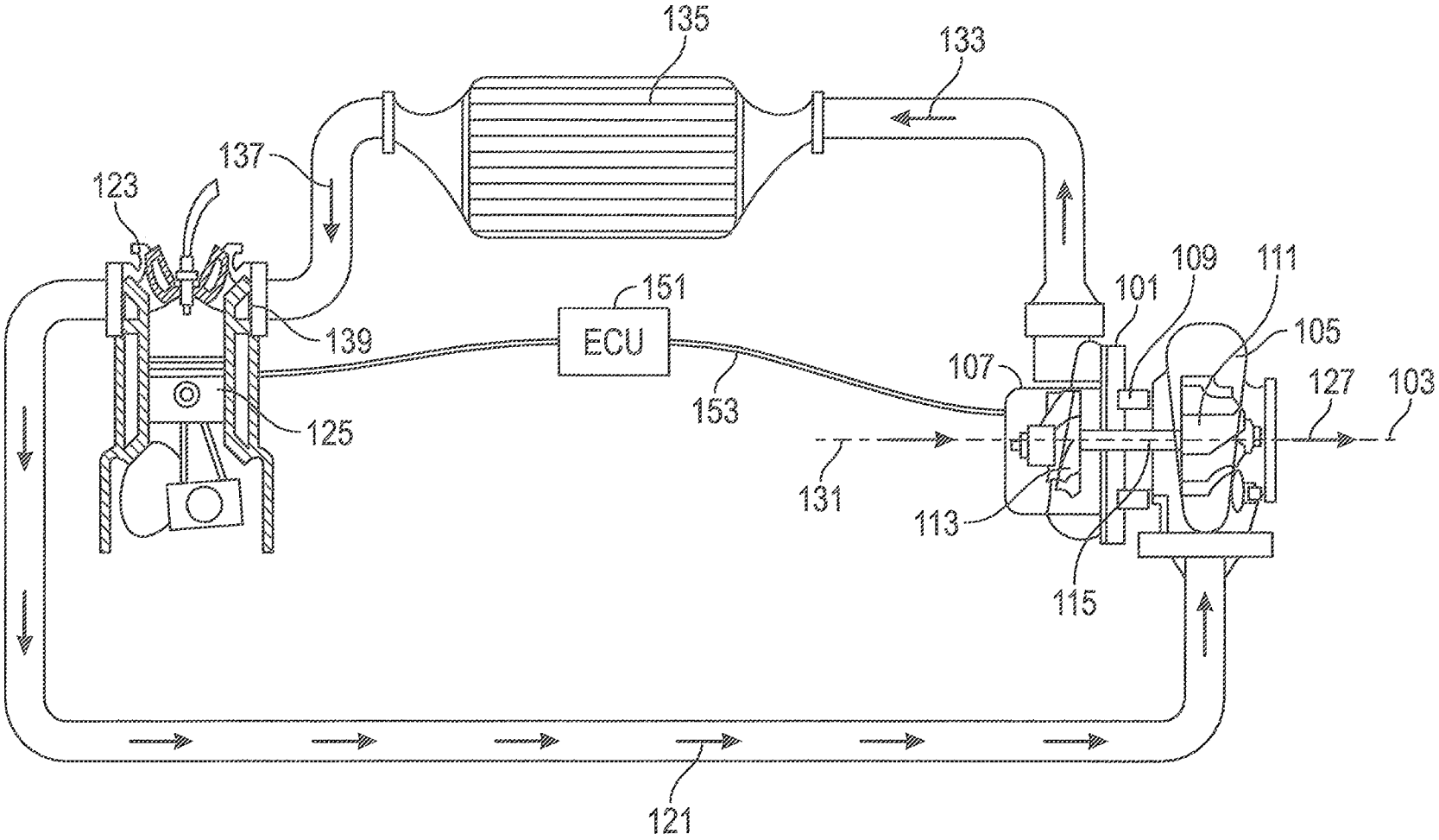
103
127
105
111
109
101
115
107
113
133
131
153
135
151
ECU
121
139
125
137
123

FERRITIC STAINLESS STEEL ALLOYS AND TURBOCHARGER KINEMATIC COMPONENTS FORMED FROM STAINLESS STEEL ALLOYS

TECHNICAL FIELD

The present disclosure generally relates to iron-based alloys, such as ferritic stainless steel alloys, and articles of manufacture formed therefrom. More particularly, the present disclosure relates to stainless steel alloys used in (for example) turbine and turbocharger kinematic components, wherein such kinematic components exhibit increased wear resistance.

BACKGROUND

In the context of turbine engines, turbochargers use heat and volumetric flow of engine exhaust gas to pressurize or boost an intake air stream into a combustion chamber. Specifically, exhaust gas from the engine is routed into a turbocharger turbine housing. A turbine is mounted inside the housing, and the exhaust gas flow causes the turbine to spin. The turbine is mounted on one end of a shaft that has a radial air compressor mounted on an opposite end thereof. Thus, rotary action of the turbine also causes the air compressor to spin. The spinning action of the air compressor causes intake air to enter a compressor housing and to be pressurized or boosted before the intake air is mixed with fuel and combusted within the engine combustion chamber.

Various systems within turbochargers include tribological interfaces, that is, surfaces of components that interact with and move relative to one another while the turbocharger is in operation. Such components, which are commonly referred to as kinematic components, may be susceptible to friction and wear, even when temperatures are not elevated (relative to other portions of the turbocharger), which reduces their service life. Examples of turbocharger systems that may include kinematic components commonly include various components such as shafts, bushings, valves, and the like, which are kinematic components because they interact and move relative to one another, and they are thus subject to friction wear. In the prior art, substantial effort has been placed on high-temperature wear-resistant application, where austenitic stainless steels are employed, but such stainless steel has proven undesirable in relatively lower-temperature applications due to its relatively high cost 310-grade stainless steel may have been used for such components, but such stainless steel has proven undesirable due to its relatively high cost. An effective (and less expensive) substitute therefore would be welcome in the art, as long as the appropriate material properties are retained. An effective (and less expensive) ferritic option therefore would be welcome in the art, as long as the appropriate material properties are retained.

Accordingly, it is desirable to provide materials that are suitable for use in fabricating kinematic components for turbine engines that can resist wear, and may be suitable for relatively lower-temperature applications in turbochargers. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Ferritic stainless steel alloys, and turbocharger kinematic components fabricated from such alloys, are provided.

In an embodiment, by way of example only, a ferritic stainless steel alloy includes or consists of, by weight, about 20% to about 35% chromium, less than about 2% nickel (i.e., from 0% to about 2%), about 1% to about 4% carbon, about 1.5% to about 1.9% silicon, less than about 0.4% nitrogen (i.e., from 0% to about 0.4%), about 0.5% to about 15% molybdenum, less than about 1% niobium (i.e., from 0% to about 1%) and a balance of iron, and other inevitable/unavoidable impurities that are present in trace amounts.

With regard to the foregoing alloy embodiments: the amount of chromium may be limited to about 22% to about 33%, or about 24% to about 31%, or about 26% to about 29%; alternatively or additionally, the amount of nickel may be limited to about 0.1% to about 1.5%, or about 0.2% to about 1%; alternatively or additionally, the amount of carbon may be limited to about 1.5% to about 3.5%, or about 2% to about 3%%; alternatively or additionally, the amount of silicon may be limited to about 1.6% to about 1.8%; alternatively or additionally, the amount of nitrogen may be limited to about 0.05% to about 0.3%, or about 0.1% to about 0.2%; alternatively or additionally, the amount of niobium may be limited to about 0.05% to about 0.7%, or about a 1% to about 0.5%; and, alternatively or additionally, the amount of molybdenum may be limited to about 2% to about 13%, or about 40 to about 11%, or about 6% to about 9%.

In another embodiment, by way of example only, a turbocharger kinematic component is fabricated using, at least in part, a ferritic stainless steel alloy that includes or consists of, by weight, about 20% to about 35% chromium, less than about 2% nickel (i.e., from 0% to about 2%), about 1% to about 4% carbon, about 1.5% to about 1.9% silicon, less than about 0.4% nitrogen (i.e., from 0% to about (1.4%), about 0.5% to about 15% molybdenum, less than about 1% niobium (i.e., from 0% to about 1%) and a balance of iron, and other inevitable/unavoidable impurities that are present in trace amounts.

With regard to the foregoing turbocharger kinematic component embodiments, and in particular to the ferritic stainless steel alloy used to fabricate the same: the amount of chromium may be limited to about 22% to about 33%, or about 24% to about 31%, or about 26% to about 29%; alternatively or additionally, the amount of nickel may be limited to about 0.1% to about 1.5%, or about 0.2% to about 1%; alternatively or additionally, the amount of carbon may be limited to about 1.5% to about 3.5%, or about 2% to about 3%%; alternatively or additionally, the amount of silicon may be limited to about 1.6% to about 1.8%; alternatively or additionally, the amount of nitrogen may be limited to about 0.05% to about 0.3%, or about 0.1% to about 0.2%; alternatively or additionally, the amount of niobium may be limited to about 0.05% to about 0.7%, or about 0.1% to about 0.5%; and, alternatively or additionally, the amount of molybdenum may be limited to about 2% to about 13%, or about 4% to about 11%, or about 6% to about 9%.

In a particular embodiment of the present disclosure, disclosed is a turbocharger kinematic component comprising, at least as a part of its constituency, a ferritic stainless steel alloy, wherein the ferritic stainless steel alloy includes or consists of, by weight: about 24% to about 31% chromium, about 0.2%% to about 1% nickel, about 2% to about 3% carbon, about 1.6% to about 1.8% silicon, about 0.1% to about 0.2% nitrogen, about 4% to about 11% molybdenum, about 0.1% to about 0.5% niobium, and a balance of iron, and other inevitable/unavoidable impurities that are present in trace amounts.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The inventive subject matter will hereinafter be described in conjunction with the following drawing FIGURE, wherein like numerals denote like elements, and wherein:

FIG. 1 is a system view of an embodiment of a turbocharged internal combustion engine in accordance with the present disclosure.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Unless specifically stated or obvious from context, as used herein, the term "about" is understood as within a range of normal tolerance in the art, for example within 2 standard deviations of the mean. "About" can be understood as within 10%, 5%, 1%, 0.5%, 0.1%, 0.05%, or 0.01% of the stated value. "About" can alternatively be understood as implying the exact value stated. Unless otherwise clear from the context, all numerical values provided herein are modified by the term "about."

All of the ferritic stainless steel alloys described herein may be understood as either: (1) "comprising" the listed elements in their various percentages, in an open-ended context or (2) "consisting of" the listed elements in their various percentages, in a closed-ended context. Alternatively, the ferritic stainless steel alloys described herein may be understood as (3) "consisting essentially of" the listed elements in their various percentages, wherein other elements may be present in amounts not effecting the novel/nonobvious characteristics of the alloy. Thus, as used herein, the terms "comprising," "consisting of," and "consisting essentially of" should be understood as applicable to all of the ranges of alloy compositions disclosed herein.

All of the embodiments and implementations of the ferritic stainless steel alloys, turbocharger kinematic components, and methods for the manufacture thereof described herein are exemplary embodiments provided to enable persons skilled in the art to make or use the invention and not to limit the scope of the invention, which is defined by the claims. Of course, the described embodiments should not be considered limited to such components, but they may be considered applicable to any articles of manufacture where an iron alloy, or a stainless steel alloy may be employed. Furthermore, there is no intention to be bound by any expressed or implied theory presented in the preceding technical field, background, brief summary, or the following detailed description.

As noted above, the present disclosure is directed to ferritic stainless steel alloys for use in kinematic components of a turbocharger (for use in various vehicles and other applications) for purposes for wear with regard to the use and implementation of such kinematic components. Accordingly, for completeness of description, With reference to FIG. 1, an exemplary embodiment of a turbocharger 101 having a radial turbine and a radial compressor includes a turbocharger housing and a rotor configured to rotate within the turbocharger housing around an axis of rotor rotation 103 during turbocharger operation on thrust bearings and two sets of journal bearings (one for each respective rotor wheel), or alternatively, other similarly supportive bearings. The turbocharger housing includes a turbine housing 105, a compressor housing 107, and a bearing housing 109 (i.e., a center housing that contains the bearings) that connects the turbine housing to the compressor housing. The rotor includes a radial turbine wheel 111 located substantially within the turbine housing 105, a radial compressor wheel 113 located substantially within the compressor housing 107, and a shaft 115 extending along the axis of rotor rotation 103, through the bearing housing 109, to connect the turbine wheel 111 to the compressor wheel 113.

The turbine housing 105 and turbine wheel 111 form a turbine configured to circumferentially receive a high-pressure and high-temperature exhaust gas stream 121 from an engine, e.g., from an exhaust manifold 123 of an internal combustion engine 125. The turbine wheel 111 (and thus the rotor) is driven in rotation around the axis of rotor rotation 103 by the high-pressure and high-temperature exhaust gas stream, which becomes a lower-pressure and lower-temperature exhaust gas stream 127 and is axially released into an exhaust system (not shown).

The compressor housing 107 and compressor wheel 113 form a compressor stage. The compressor wheel, being driven in rotation by the exhaust-gas driven turbine wheel 111, is configured to compress axially received input air (e.g., ambient air 131, or already-pressurized air from a previous-stage in a multi-stage compressor) into a pressurized air stream 133 that is ejected circumferentially from the compressor. Due to the compression process, the pressurized air stream is characterized by an increased temperature over that of the input air.

Optionally, the pressurized air stream may be channeled through a convectively cooled charge air cooler 135 configured to dissipate heat from the pressurized air stream, increasing its density. The resulting cooled and pressurized output air stream 137 is channeled into an intake manifold 139 on the internal combustion engine, or alternatively, into a subsequent-stage, in-series compressor. The operation of the system is controlled by an ECU 151 (engine control unit) that connects to the remainder of the system via communication connections 153.

Typical embodiments of the present disclosure reside in a motor vehicle equipped with a gasoline or diesel powered internal combustion engine and a turbocharger. The turbocharger is equipped with a unique combination of features that may, in various embodiments, provide efficiency benefits by relatively limiting the amount of (and kinetic energy of) secondary flow in the turbine and/or compressor, as compared to a comparable unimproved system. Stainless steel alloys for use in turbochargers may have operating temperatures up to about 800° C. (or up to about 850° C.), for example. Some embodiments of the present disclosure are directed to stainless steel alloys that include iron alloyed with various alloying elements, as are described in greater detail below in weight percentages based on the total weight of the alloy. The description of particular effects with regard to the inclusion of certain weight percentages of materials, as set forth below, are particular to the alloy of the present disclosure, and as such should not be understood as applying to any other alloy. Moreover, the description of particular effects with regard to the inclusion of certain weight percentages of materials is not intended to limit the scope or content of the present disclosure.

As such, in an embodiment, the stainless steel alloy of the present disclosure includes from about 20% to about 35% chromium (Cr), for example from about 22% to about 33% Cr, such as about 24% to about 31% Cr, or about 26% to about 29% Cr. Chromium hardens and toughens steel and increases its resistance to corrosion. It has been discovered that if Cr is added excessively, coarse primary carbides of Cr are formed, resulting in extreme brittleness. As such, the content of Cr is preferably limited to a maximum of about 35% so as to maintain an appropriate volume fraction within the stainless steel for corrosion resistance.

In an embodiment, the stainless steel alloy of the present disclosure minimizes nickel to the extent practical, as nickel is associated with the formation of an austenite phase. Accordingly, the stainless steel alloy includes less than about 2% nickel (Ni) (i.e., about 0% to about 2% nickel), for example about 0.1% to about 1.5% Ni, for example about 0.2% to about 1% Ni. To the extent that nickel is included at all, it may have some benefit with regard to formability, weldability, and ductility.

In an embodiment, the stainless steel alloy of the present disclosure includes from about 0.5% to about 15% molybdenum (Mo), such as about 2% to about 13% Mo, for example about 4% to about 11% Mo, or about 6% to about 9% Mo. Molybdenum is a ferrite stabilizer, and as such is included in the stainless steel alloy of the present disclosure to achieve a ferritic alloy. Moreover, molybdenum has the benefit of providing the alloy with resistance to pitting and corrosion.

In an embodiment, the stainless steel alloy of the present disclosure includes from about 1% to about 4% carbon (C), for example about 1.5% to about 3.5% C, such as about 2% to about 3% C. C has a function of improving the sintering ability of the alloy. C, when present in the relatively-high disclosed range, also forms a eutectic carbide with niobium (which, as discussed in greater detail below, may also be included in the alloy), which improves wear resistance. To exhibit such functions effectively, the amount of C should be 1% or more. Further, C is effective for strengthening a material by solid solution strengthening. To maximize the corrosion resistance, the content of C is lowered to about 4% and below.

In an embodiment, the stainless steel alloy of the present disclosure includes from about 1.5% to about 1.9% silicon (Si), for example about 1.6% to about 1.5% Si. A specific embodiment may employ about 1.7% Si. Si has effects of increasing the stability of the alloy metal structure and its oxidation resistance. Further, Si has functions as a deoxidizer and also is effective for improving castability and reducing pin holes in the resulting sintered products, when present in an amount greater than about 1.5%. If the content of Si is excessive, Si deteriorates the mechanical property such as impact toughness of stainless steel. Therefore, the content of Si is preferably limited to about 1.9% and below.

In an embodiment, the stainless steel alloy of the present disclosure includes less than about 0.4% nitrogen (N) (i.e., about 0% to about 0.4%), for example about 0.05% to about 0.3% N, or about 0.1% to about 0.2% N. The addition of nitrogen to the alloy, if desired, in the foregoing amount allows for improved ductility to enable casting of the alloy into the desired form (i.e., a turbocharger kinematic component). Nitrogen, if included, should be limited to no more than about 0.4%, to avoid brittleness in the formed alloy. As such, the presently disclosed alloy may include nitrogen in the foregoing amounts.

In an embodiment, the ferritic stainless steel alloy of the present disclosure optionally includes less than about 1% niobium (Nb) (i.e., about 0% to about 1%), for example about 0.05% to about 0.7% Nb, such as about 0.1% to about 0.5% Nb. The wear-resistant ferritic steel of the present disclosure may be provided with some castability benefit by forming eutectic carbides of Nb, to the extent Nb is included, possibly also a benefit with respect to strength and ductility. As Nb is relatively expensive, however, Nb may be minimized within the foregoing amounts, if included.

Certain inevitable/unavoidable impurities may also be present in the stainless steel alloy of the present disclosure, for example as described below with regard to phosphorous and sulfur (the amounts of such described impurities (and others) are minimized as much as practical).

In an embodiment, phosphorus (P) may be present in the alloy, but is minimized to about 0.04% or less. P is seeded in the grain boundary or an interface, and is likely to deteriorate the corrosion resistance and toughness. Therefore, the content of P is lowered as low as possible. Preferably, the upper limit content of P is limited to 0.04% in consideration of the efficiency of a refining process. The contents of harmful impurities, such as P are as small as possible. However, due to cost concerns associated with removal of these impurities, and the P content is limited to 0.04%.

In an embodiment, sulfur (S) may be present in the alloy, but it is minimized to about 0.01% or less. S in steels deteriorates hot workability and can form sulfide inclusions that influence pitting corrosion resistance negatively. It should therefore be limited to less than 0.01%. S deteriorates the hot formability, thereby deteriorating the corrosion resistance. Therefore, the content of S is lowered as low as possible. The contents of harmful impurities, such as S (sulfur), are as small as possible. However, due to cost concerns associated with removal of these impurities, the S content is limited to about 0.01%.

In some embodiments, high-cost elements that have in the prior art been proposed for inclusion in stainless steels are specifically excluded from the alloy (except in unavoidable impurity amounts). These excludable elements are, for example, Mn, W, Co, and V. Any number or combination of the foregoing elements may be excluded, in various embodiments.

The disclosed alloys, being stainless steel alloys, also include a balance of iron (Fe). As used herein, the term "balance" refers to the amount remain to achieve 100% of a total alloy, in terms of weight. It should be appreciated that this amount may differ if an embodiment "comprises," "consists of," or "consists essentially of" the stated elements, with the balance being Fe.

The articles of manufacture described herein, such as the kinematic components of a turbocharger fabricated with the above-described stainless steel alloys, may be formed using sintering processes. For example, as is known in the art, sintering refers to a process of compacting and forming a solid mass of material by heat and/or pressure without melting the material to the point of liquefaction. The articles may also be fabricated using a casting process, or a metal injection molding (MIM) process, or they may be wrought.

As such, embodiments of the present disclosure provide materials that are suitable for use in fabricating kinematic components for turbine engines that can resist wear, where operation a relatively elevated temperatures is not required. As noted above, examples of turbocharger systems that may include shafts, bushings, valves, and the like. Of course, the described embodiments should not be considered limited to such components, but they may be considered applicable to any articles of manufacture where an iron alloy, or a stainless steel alloy may be employed. The described material may provide an effective, and low cost, substitute for austenitic alloys where relatively high-temperature operation is not required.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A ferritic stainless steel alloy, comprising, by weight:
20% to 35% chromium,
0% to 2% nickel,
0.5% to 15% molybdenum,
1% to 4% carbon,
1.6% to 1.8% silicon,
0% to 0.4% nitrogen,
0% to 1% niobium, and
a balance of iron, and other inevitable/unavoidable impurities that are present in trace amounts, and wherein vanadium is excluded from the alloy beyond impurity levels.

2. The ferritic stainless steel alloy of claim 1, comprising 22% to 33% chromium.

3. The ferritic stainless steel alloy of claim 1, comprising 0.1% to 1.5% nickel.

4. The ferritic stainless steel alloy of claim 1, comprising 0.05% to 0.7% niobium.

5. The ferritic stainless steel alloy of claim 1, comprising 2% to 13% molybdenum.

6. The ferritic stainless steel alloy of claim 1 comprising 1.5% to 3.5% carbon.

7. The ferritic stainless steel alloy of claim 1, comprising 0.05% to 0.3% nitrogen.

8. The ferritic stainless steel alloy of claim 1, further comprising sulfur in an amount of less than 0.01% and phosphorous in an amount of less than 0.04%.

9. A turbocharger kinematic component comprising, at least as a part of its constituency:
a ferritic stainless steel alloy, wherein the ferritic stainless steel alloy comprises, by weight:
20% to 35% chromium,
0% to 2% nickel,
0.5% to 15% molybdenum,
1% to 4% carbon,
1.6% to 1.8% silicon,
0% to 0.4% nitrogen,
0% to 1% niobium, and
a balance of iron, and other inevitable/unavoidable impurities that are present in trace amounts, and wherein vanadium is excluded from the alloy beyond impurity levels.

10. The turbocharger kinematic component of claim 9, wherein the ferritic stainless steel alloy comprises 22% to 33% chromium.

11. The turbocharger kinematic component of claim 9, wherein the ferritic stainless steel alloy comprises 0.1% to 1.5% nickel.

12. The turbocharger kinematic component of claim 9, wherein the ferritic stainless steel alloy comprises 0.05% to 0.7% niobium.

13. The turbocharger kinematic component of claim 9, wherein the ferritic stainless steel alloy comprises 2% to 13% molybdenum.

14. The turbocharger kinematic component of claim 9, wherein the ferritic stainless steel alloy comprises 1.5% to 3.5% carbon.

15. The turbocharger kinematic component of claim 9, wherein the ferritic stainless steel alloy comprises 0.05% to 0.3% nitrogen.

16. The turbocharger kinematic component of claim 9, wherein the ferritic stainless steel alloy comprises sulfur in an amount of less than 0.01% and phosphorous in an amount of less than 0.04%.

17. The turbocharger kinematic component of claim 9, wherein the turbocharger kinematic component comprises a shaft, bushing, or valve.

18. A turbocharger comprising the turbocharger kinematic component of claim 9.

* * * * *